United States Patent [19]

Criscimagna et al.

[11] Patent Number: 4,570,159

[45] Date of Patent: Feb. 11, 1986

[54] "SELSTAIN" INTEGRATED CIRCUITRY

[75] Inventors: Tony N. Criscimagna, Woodstock, N.Y.; William J. Martin, San Jose, Calif.

[73] Assignee: International Business Machines Corporation, Armonk, N.Y.

[21] Appl. No.: 406,401

[22] Filed: Aug. 9, 1982

[51] Int. Cl.[4] ..... G09G 3/28

[52] U.S. Cl. ..... 340/776; 340/778; 315/169.1

[58] Field of Search ..... 340/776, 777, 778, 805, 340/811; 315/169.1, 169.4

[56] References Cited

U.S. PATENT DOCUMENTS

| | | | |
|---|---|---|---|
| 3,611,296 | 10/1971 | Johnson | 340/777 |
| 3,614,739 | 10/1971 | Johnson | 340/777 |
| 3,973,253 | 8/1976 | Criscimagna et al. | 340/778 |
| 3,976,912 | 8/1976 | Miavecz et al. | 340/776 |
| 4,370,651 | 1/1983 | Reible, Jr. | 340/777 |

*Primary Examiner*—Marshall M. Curtis

*Attorney, Agent, or Firm*—J. J. Connerton; M. Smith; J. Jancin, Jr.

[57] ABSTRACT

A system for providing sustain, write and erase operations in an AC plasma gas display panel in which selstain circuits are created by integrating the sustain and selection functions. Each selstain circuit is deposited on a single integrate circuit. This circuit is fabricated with low voltage integrated circuit technology. In addition, the sustain signal is floated on the write/erase signal.

23 Claims, 2 Drawing Figures

"SELSTAIN" INTEGRATED CIRCUITRY

DESCRIPTION

1. Cross Reference To Related Application

U.S. application Ser. No. 372,384, "Improved Method and Apparatus for Gas Display Panel", filed by Tony N. Criscimagna et al, June 21, 1973.

2. Technical Field

The invention relates to the integration of the sustain and selection functions for an AC plasma gas display panel into a single integrated circuit configuration with low voltage integrated circuit technology.

3. Background Art

One of the conventional AC plasma gas display panel operating techniques as described in the above referenced application Ser. No. 372,384 is to float the write/erase signals on top of the sustain signals. In such a system, the write/erase signals are electrically referenced to the sustain signals which comprise a high voltage high current background circuit. Among the disadvantages of a background sustainer is the high power high peak current which must be generated by the sustainer and distributed to all the drive lines. Such high voltage circuitry is at the leading edge of the integrated circuit packaging art and consequently expensive. Furthermore, most of these operating techniques employ separate circuits to implement the sustain and the selection functions. Even techniques which have employed a single integrated circuit package to perform both the sustain and selection functions continue to segregate these functions from one another. This segregation is primarily due to power requirements.

The primary disadvantages of the prior art techniques which employ separate circuits within separate devices to perform the selection and sustain functions include increased packaging costs, high sustain circuit current, additional background circuitry and degraded gas panel performance due to parasitic inductance between the separate circuits and the gas panel. The basic disadvantage is that the background sustain circuitry must be implemented in high voltage high current packaging which results in very high cost.

The present invention overcomes the disadvantages of the prior art by employing a technique which floats the sustain signals on the write/erase signals, and in which the sustain signals are selectively applied under the control of selection switches. The sustain, write and selection functions are also integrated into a "selstain" function which permits packaging with low voltage integrated circuit technology.

DISCLOSURE OF THE INVENTION

The present invention is a system for providing sustain, write and erase operations in an AC plasma gas display panel in which selstain circuits (i.e. circuits which functionally integrate the sustain function and the select function) selectively place either a write/erase signal or the sum of a write/erase signal and a sustain signal on the selected horizontal gas panel lines and either a sustain signal or ground on the vertical gas panel lines. A write/erase switch selectively connects a write/erase signal source to a horizontal selstain circuit, and a sustain switch selectively connects ground to the horizontal selstain circuit. A capacitor, connected to a sustain signal source, the write/erase switch, the sustain switch, and the horizontal selstain circuit serves as a voltage storage device. Since a gas panel may include 1000×1000 drive lines, a plurality of the circuits in this system can be included on a single integrated circuit. Due to the circuit configuration of the present invention which reduces the voltage levels such an integrated circuit must withstand, this device can be fabricated with low voltage integrated circuit technology. In addition, the sustain signal is floated on the write/erase signal in the system of the present invention, rather than vice-versa as in the prior art.

BEST MODE FOR CARRYING OUT THE INVENTION

Figure 1:
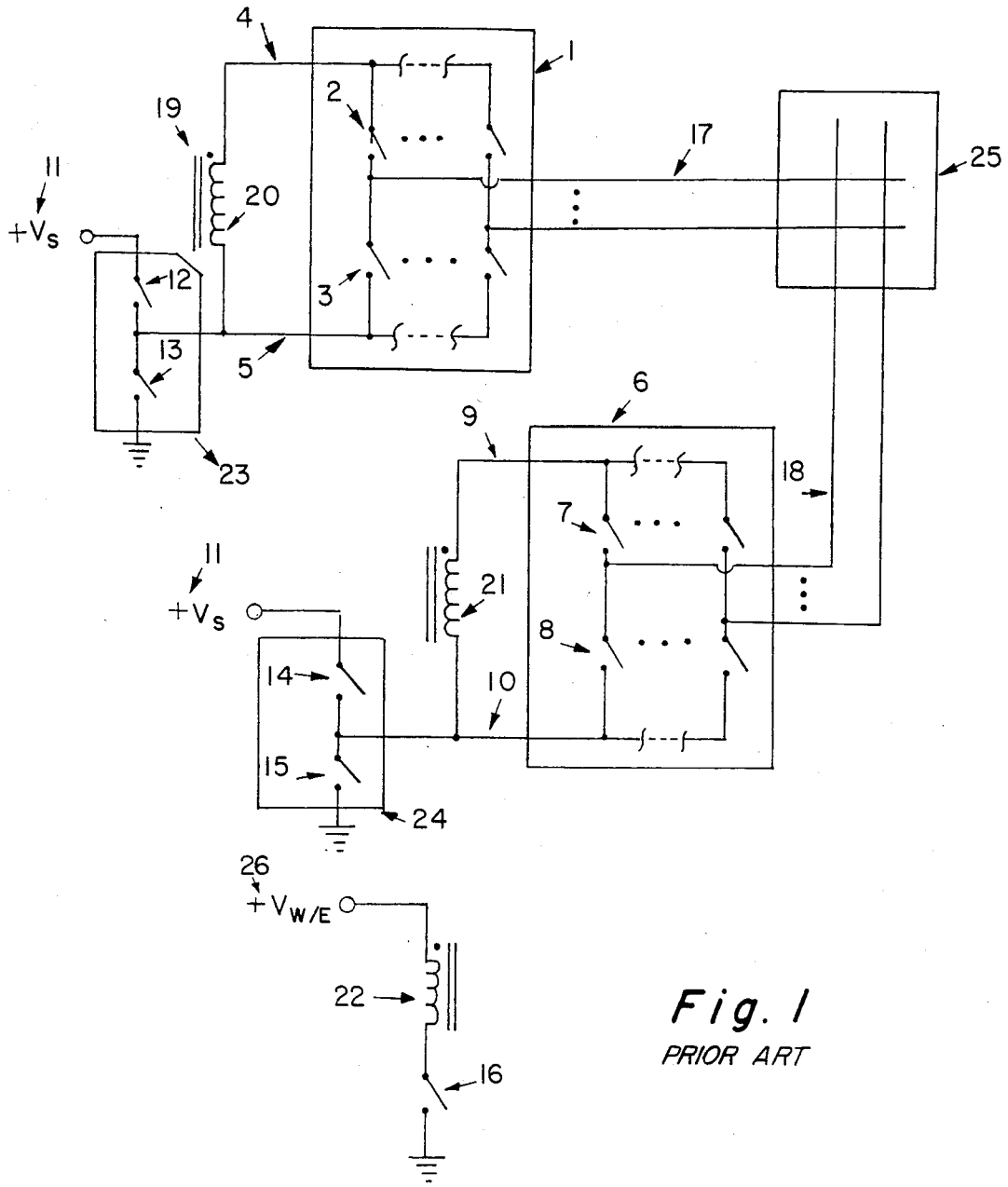
Fig. 1 PRIOR ART
FIG. 1 is a circuit diagram of a typical prior art system for providing sustain, write and erase operations in an AC plasma gas display panel.

FIG. 1 represents the basic topology of the technique used in present day gas panels. While the invention and the prior art are illustrated and described in terms of mechanical switching for purposes of clarity, it will be appreciated that in practice electronic switches such as FET's adaptable for low voltage integrated circuitry packaging as heretofore described are contemplated for the present invention. In addition, all voltage levels described herein are zero-to-peak voltage levels. Horizontal selection circuit 1 has a pair of switches 2, 3 for each horizontal line 17 going to gas panel 25. Switch 2 is designated a horizontal upper switch, while switch 3 is designated a horizontal lower switch. Alternatively, switch 2 may be a resistor which performs the same function as the switch in providing a path from upper horizontal bus 4 to horizontal panel line 17. There are a plurality of switch pairs 2, 3 connecting upper horizontal bus 4 to lower horizontal bus 5; one pair for each horizontal line. Vertical selection circuit 6 is substantially identical to horizontal selection circuit 1. Vertical selection circuit 6 has a pair of switches 7, 8 for each vertical line 18 going to gas panel 25. Switch 7 is designated a vertical upper switch, while switch 8 is designated a vertical lower switch. Again, there are a plurality of pairs of switches 7, 8 corresponding to the number of vertical drive lines connecting upper vertical bus 9 to lower vertical bus 10; one pair for each vertical line.

There are essentially three modes of operation for the plasma display system of FIG. 1: a sustain mode, write mode and an erase mode. In the sustain mode, selection circuits 1, 6 are idle. All lower switches 3, 8 are closed and all upper switches 2, 7 are open. In this manner, all horizontal panel lines 17 are connected to bus 5 and all vertical panel lines 18 are connected to bus 10. A sustain signal is then generated by simply alternately opening/closing switch 12 and switch 13. Vertical sustainer 24 operates in the same fashion as horizontal sustainer 23, but the vertical sustain signal is 180 degrees out of phase with the horizontal systain so that bus 10 is held to ground while bus 5 is held to the level of the sustain signal source 11, and vice-versa. It is apparent that the reference for selection circuits 1, 6 are buses 5, 10, respectively. This reference floats up and down on the sustain signal.

To operate in the write or erase mode, sustainers 23, 24 are stopped in a particular state depending upon what operation is desired. There are certain requirements in write and erase sequences relative to the sustain sequence. In write, the polarity of the initial write signal must correspond to that of the last sustain signal; in erase, the polarity of the erase signal must be opposite to that of the last sustain signal. The term sequence is used to designate one or more signals which may be used in any of the three operations. For example, if sustainers 23, 24 are stopped with switch 12 closed, switch 13 open, switch 14 open and switch 15 closed; bus 5 is held at the level of sustain signal source 11 (e.g. 100 V) and bus 10 is held at ground. At this time switches 2, 3, 7 and 8 within selection circuits 1, 6 are set as desired to selectively connect each panel line to either the upper or lower bus as desired, independently of the state of the other panel lines. Write/erase switch 16 is then briefly held closed to put a write/erase signal through transformer 19 (transformer 19 consists of primary winding 22 and secondary windings 20, 21). This places the level of write/erase signal source 26 (e.g. 80 V) between the upper and lower buses of each set of selection circuits 1, 6. Note that the write/erase signal is floated on top of the sustain signal, i.e., the signal from transformer 19 is referenced to the lower bus which floats on the sustainer output. In this system, selection circuits 1, 6 are required to withstand the level of the write/erase signal source 26 (e.g., 80 V) as these selection circuits 1, 6 see only the difference between the upper and lower buses 4, 9 and 5, 10, respectively. Eighty volt selection circuits are well within the state of the integrated circuit art.

Some prior art systems have used the techniques described above in conjunction with FIG. 1, but have integrated the background sustainer and selection circuits onto a common integrated circuit package. Because of this integration, high voltage devices are required. During a write operation, for example, one side of switch 23 is held at ground, bus 5 is held at the level of sustain signal source 11 by switch 12 (e.g., 100 V) and bus 4 is held at a level which is the sum of the level of sustain signal source 11 (e.g., 100 V) and the level of write/erase signal source 26 (e.g., 80 V). It is apparent that any device which contains both switch 13 and selection circuit 1 must withstand the difference between ground and the level of bus 4 (e.g., 180 V). This is the result of one side of switch 13 being tied to ground and the write signal floating on top of the sustain signal.

Figure 2:
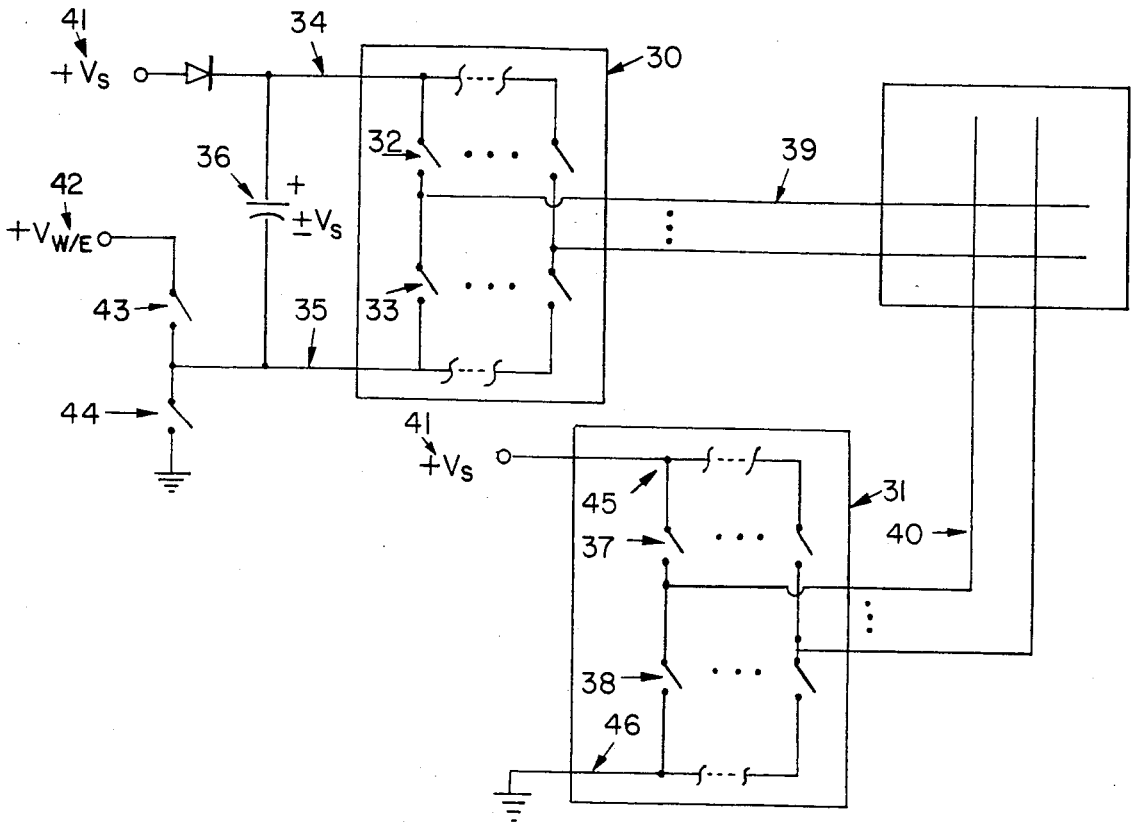
FIG. 2 is a circuit diagram of a preferred embodiment of the present invention.

Referring now to FIG. 2, which illustrates the subject invention in analog schematic form, the present invention has a horizontal selstain circuit 30 and a vertical selstain circuit 31 which are topologically similar to horizontal selection circuit 1 and vertical selection circuit 6 of FIG. 1, respectively. The functions performed by horizontal selstain 30 and vertical selstain 31, however, are different than the functions performed by selection circuits 1, 6 of FIG. 1. Like the prior art system of FIG. 1, the system of the present invention basically operates in three modes: sustain mode, write mode or erase mode. In the sustain mode, sustain switch 44 is held closed at all times and is not required to constantly switch on and off as in the prior art. To generate the required horizontal sustain signal, horizontal upper switch 32 and horizontal lower switch 33 are alternately opened and closed at the proper rate in synchronism with one another. In this manner, the sustain signal for each horizontal line 39 is generated by its own selstain circuit rather than from a common sustainer, as in the prior art. These independent selstain circuits are synchronized such that all panel lines 39 see the same signals. The vertical sustain signal is generated in an equivalent fashion as vertical upper switch 37 and vertical lower switch 38 are opened and closed in synchronism with one another.

In the write or erase mode, sustain switch 44 is opened and write/erase switch 43 closed at a time when horizontal lower switch 33 is closed, thereby driving lower horizontal bus 35 to the level of the write/erase signal source 42 (e.g., 80 V). Due to the voltage stored on capacitor 36 during the sustain mode, upper horizontal bus 34 rises to a level equal to the sum of the level of sustain signal source 41 and the level of write/erase signal source 42. The various switches in selstain circuit 30 can now be set to whatever state is desired to select or deselect individual horizontal panel lines 39 to write or erase selected cells. A difference in voltage equal to the sum of the level of sustain signal source 41 and the level of write/erase signal source 42 is needed between panel line 39 and panel line 40 to discharge or write the cell which is formed at the intersection of these panel lines. It is apparent in the configuration of FIG. 2 that the selstain circuit reference level of lower horizontal bus 35 now floats up and down on the write/erase signal generated by write/erase switch 43. This is in contrast to the prior art configuration of FIG. 1, where the write/erase signal floats on the sustain signal. It is also clear that the maximum voltage which selstain circuits 30, 31 must withstand is only the level of sustain signal source 41 (e.g., 100 V). The level of the sustain signal source is typically in the range of 80–110 V. As heretofore described, this voltage is substantially lower than the voltage the selection circuit 1 of FIG. 1 must withstand when sustainer 23 is combined with the level of write/erase signal source 42. This voltage difference allows selstain circuits 30, 31 to be fabricated from low voltage integrated circuit technology.

The nature of writing and erasing gas panels is such that a relatively small current flow is required of write/erase switch 43; therefore, write/erase switch 43 could also be included in the selstain integrated circuit along with selstain circuit 30. In addition, although it may not always represent the optimum practical device, it should be noted as evident to someone skilled in this art, that capacitor 36 might also be included in the selstain integrated circuit.

While we have illustrated and described the preferred embodiments of our invention, it is to be understood that we do not limit ourselves to the precise constructions disclosed and the right is reserved to all changes and modifications coming within the scope of the invention as defined in the appended claims.

We claim:

1. A system for providing sustain, write and erase operations in an AC plasma gas display panel comprising:

a sustain signal source for producing a sustain signal;

a background circuit comprising a write/erase signal source for producing a write/erase signal;

a sustain signal floating on said write/erase signal;

an upper horizontal bus connected to said sustain signal source;

a write/erase switch having a first side and a second side, said first side connected to said write/erase signal source;

a sustain switch having a first side and a second side, said first side of said sustain switch connected to ground and said second side of said sustain switch connected to said second side of said write/erase switch;

a lower horizontal bus connected to said second side of said write/erase switch and said second side of said sustain switch;

a capacitor connected between said upper horizontal bus and said lower horizontal bus;

a plurality of horizontal gas panel lines;

a plurality of horizontal switch pairs disposed between said upper horizontal bus and said lower horizontal bus, each of said horizontal switch pairs further comprising:

a horizontal upper switch having a first side and a second side and a horizontal lower switch having a first side and a second side, said first side of said horizontal upper switch connected to said upper horizontal bus, said first side of said horizontal lower switch connected to said lower horizontal bus, and said second side of said horizontal lower switch connected to one of said plurality of horizontal gas panel lines;

an upper vertical bus connected to said sustain signal source;

a lower vertical bus connected to ground;

a plurality of vertical gas panel lines;

a plurality of vertical switch pairs disposed between said upper vertical bus and said lower vertical bus, each of said vertical switch pairs further comprising:

a vertical upper switch having a first side and a second side and a vertical lower switch having a first side and a second side, said first side of said vertical upper switch connected to said upper vertical bus, said first side of said vertical lower switch connected to said lower vertical bus, and said second side of said vertical upper switch and said second side of said vertical lower switch connected to one of said plurality of vertical gas panel lines whereby said write/erase switch, said sustain switch, said plurality of horizontal switch pairs, and said plurality of vertical switch pairs are synchronously operated to sustain, write and erase said display panel.

2. A system according to claim 1 wherein said upper horizontal bus, said lower horizontal bus and said plurality of horizontal switch pairs are deposited on a single integrated circuit.

3. A system according to claim 1 wherein said upper vertical bus, said lower vertical bus and said plurality of vertical switch pairs are deposited on a single integrated circuit.

4. A system according to claim 1 wherein said upper horizontal bus, said lower horizontal bus, said plurality of horizontal switch pairs and said capacitor are deposited on a single integrated circuit.

5. A system according to claim 1 wherein said write/erase switch, said upper horizontal bus, said lower horizontal bus and said plurality of horizontal switch pairs are deposited on a single integrated circuit.

6. A system according to claim 1 wherein said write/erase switch, said upper horizontal bus, said lower horizontal bus, said plurality of horizontal switch pairs and said capacitors are deposited on a single integrated circuit.

7. A system according to claim 1, 2, 3, 4, 5 or 6 wherein said sustain signal is floated on said write/erase signal.

8. A system according to claim 2, 3, 4, 5 or 6 wherein said single integrated circuit is fabricated with low voltage integrated circuit technology.

9. A system according to claim 2, 3, 4, 5 or 6 wherein said single integrated circuit is fabricated to withstand a maximum voltage substantially equal to the voltage level of said sustain signal.

10. A system according to claim 2, 3, 4, 5 or 6 wherein said single integrated circuit is fabricated to withstand a maximum voltage within the range of 80 to 110 volts.

11. A system for driving a plasma gas display panel including a plurality of substantially orthogonal conductor arrays disposed on opposite sides of said panel, the intersection of said conductor arrays comprising display cells, comprising in combination:

a background circuit comprising a write/erase signal source for providing a write/erase signal;

a sustain signal source for providing a sustain signal; and a sustain signal floating on write/erase signal circuit means connected to said write/erase signal source and said sustain signal source for selectively applying said write/erase signal and said sustain signal to said conductor arrays to discharge selected cells therein.

12. A system according to claim 11 wherein said background circuit is adaptable for low voltage integrated circuit packages.

13. A system according to claim 11 wherein said background circuit is adaptable for integrated circuit packages which can withstand a maximum voltage substantially equal to the voltage level of said sustain signal.

14. A system according to claim 11 wherein said background circuit is adapatable for integrated circuit packages which can withstand a maximum voltage within the range of 80–110 volts.

15. A system for providing sustain, write and erase operations in an AC plasma gas display panel comprising:

a sustain signal source for producing a sustain signal;

a background circuit comprising a write/erase signal source for producing a write/erase signal;

a sustain signal floating on said write/erase signal;

a plurality of horizontal gas panel lines;

a plurality of vertical gas panel lines;

a horizontal selstain circuit means intermediate said sustain signal source and said plurality of horizontal gas panel lines for selectively placing said write/erase signal and the sum of said write/erase signal and said sustain signal on select ones of said horizontal gas panel lines;

a write/erase switch means intermediate said write/erase signal source and said horizontal selstain circuit means for selectively connecting said write/erase signal source to said horizontal selstain circuit means;

a sustain switch means connected to ground and said horizontal selstain circuit means for connecting said horizontal selstain circuit means with ground;

a storage capacitor having a first side and a second side, said first side of said capacitor connected to said sustain signal source and said horizontal selstain circuit means, said second side of said capacitor connected to said write/erase switch means, said sustain switch means, and said horizontal selstain circuit means; and a vertical selstain circuit means connected to said sustain signal source, ground, and said plurality of vertical gas panel lines for selectively connecting said vertical gas panel lines with said sustain signal source or ground.

whereby said horizontal selstain circuit means, said vertical selstain circuit means, said write/erase switch means and said sustain switch means are synchronously operated to sustain, write and erase said display panel.

16. A system according to claim 15 wherein said write/erase switch means and said horizontal selstain circuit means are deposited on a single integrated circuit.

17. A system according to claim 15 wherein said vertical selstain circuit means is deposited on a single integrated circuit.

18. A system according to claim 15 wherein said horizontal selstain circuit means and said capacitor are deposited on a single integrated circuit.

19. A system according to claim 15 wherein said write/erase switch means, said horizontal selstain circuit means and said capacitor are deposited on a single integrated circuit.

20. A system according to claim 15, 16, 17, 18 or 19 wherein said sustain signal is floated on said write/erase signal.

21. A system according to claim 16, 17, 18 or 19 wherein said single integrated circuit is fabricated with low voltage integrated circuit technology.

22. A system according to claim 16, 17, 18 or 19 wherein said single integrated circuit is fabricated to withstand a maximum voltage substantially equal to the voltage level of said sustain signal.

23. A system according to claim 16, 17, 18 or 19 wherein said single integrated circuit is fabricated to withstand a maximum voltage within the range of 80–110 volts.

* * * * *